US006893548B2

(12) United States Patent
Cheung et al.

(10) Patent No.: US 6,893,548 B2
(45) Date of Patent: May 17, 2005

(54) METHOD OF CONDITIONING ELECTROCHEMICAL BATHS IN PLATING TECHNOLOGY

(75) Inventors: Robin Cheung, Cupertino, CA (US); Daniel A. Carl, Pleasanton, CA (US); Liang-Yuh Chen, Foster City, CA (US); Yezdi Dordi, Palo Alto, CA (US); Paul F. Smith, Campbell, CA (US); Ratson Morad, Palo Alto, CA (US); Peter Hey, Sunnyvale, CA (US); Ashok Sinha, Palo Alto, CA (US)

(73) Assignee: Applied Materials Inc., Santa Clara, CA (US)

( * ) Notice: Subject to any disclaimer, the term of this patent is extended or adjusted under 35 U.S.C. 154(b) by 338 days.

(21) Appl. No.: 09/882,208

(22) Filed: Jun. 13, 2001

(65) Prior Publication Data

US 2002/0033340 A1 Mar. 21, 2002

Related U.S. Application Data

(60) Provisional application No. 60/211,711, filed on Jun. 15, 2000.

(51) Int. Cl.[7] ..... C25D 21/12; C25D 5/00

(52) U.S. Cl. ..... 205/81; 205/82; 205/84; 205/98; 205/101

(58) Field of Search ..... 205/81, 82, 84, 205/98, 101

(56) References Cited

U.S. PATENT DOCUMENTS

| | | | | | |
|---|---|---|---|---|---|
| 4,376,685 | A | | 3/1983 | Watson | 204/52 R |
| 4,789,445 | A | | 12/1988 | Goffman et al. | 204/114 |
| 5,017,410 | A | * | 5/1991 | Hodgens, II | 427/443.1 |
| 5,307,608 | A | | 5/1994 | Muir et al. | 53/440 |
| 6,113,769 | A | * | 9/2000 | Uzoh et al. | 205/101 |
| 6,113,771 | A | | 9/2000 | Landau et al. | 205/123 |
| 6,258,220 | B1 | | 7/2001 | Dordi et al. | 204/198 |
| 6,391,209 | B1 | * | 5/2002 | Belongia et al. | 210/748 |
| 6,458,262 | B1 | * | 10/2002 | Reid | 205/82 |
| 6,471,845 | B1 | * | 10/2002 | Dukovic et al. | 205/81 |
| 2003/0173224 | A1 | * | 9/2003 | Graham et al. | 205/81 |

FOREIGN PATENT DOCUMENTS

| | | |
|---|---|---|
| WO | 99/25903 | 5/1999 |

* cited by examiner

*Primary Examiner*—Wesley A. Nicolas
(74) *Attorney, Agent, or Firm*—Moser, Patterson & Sheridan

(57) ABSTRACT

An apparatus and method is provided for analyzing or conditioning an electrochemical bath. One aspect of the invention provides a method for analyzing an electrochemical bath in an electrochemical deposition process including providing a first electrochemical bath having a first bath composition, utilizing the first electrochemical bath in an electrochemical deposition process to form a second electrochemical bath having a second bath composition and analyzing the first and second compositions to identify one or more constituents generated in the electrochemical deposition process. Additive material having a composition that is substantially the same as all or at least some of the one or more constituents generated in the electrochemical deposition process may be added to another electrochemical bath to produce a desired chemical composition. The constituents may be added at the beginning of the use of the bath to initially condition the electrochemical bath or may be added, preferably either continuously or periodically, during the electrochemical deposition process.

8 Claims, 7 Drawing Sheets

METHOD OF CONDITIONING ELECTROCHEMICAL BATHS IN PLATING TECHNOLOGY

This application claims benefit of U.S. Provisional Patent Application Serial No. 60/211,711, which was filed on Jun. 15, 2000.

BACKGROUND OF THE INVENTION

1. Field of the Invention

The present invention relates generally to the fabrication of integrated circuits on substrates. Specific embodiments of the invention relate to methods and apparatus for adjusting electrochemical baths used for electrochemical deposition processes.

2. Background of the Invention

Sub-quarter micron, multi-level metallization is one of the key technologies for the next generation of ultra large-scale integration (ULSI). The multilevel interconnects that lie at the heart of this technology require planarization of interconnect features formed in high aspect ratio apertures, including contacts, vias, lines and other features. Reliable formation of these interconnect features is very important to the success of ULSI and to the continued effort to increase circuit density and quality on individual substrates and die.

As circuit densities increase, the widths of vias, contacts and other features, as well as the dielectric materials between them, decrease to less than 250 nanometers, whereas the thickness of the dielectric layers remains substantially constant, with the result that the aspect ratios for the features, i.e., their height divided by width, increases. Many traditional deposition processes, such as physical vapor deposition (PVD) and chemical vapor deposition (CVD), have difficulty filling structures where the aspect ratio exceed 4:1, and particularly where it exceeds 10:1. Therefore, there is a great amount of ongoing effort being directed at the formation of void-free, nanometer-sized features having high aspect ratios wherein the ratio of feature height to feature width can be 4:1 or higher.

Currently, copper and its alloys have become the metals of choice for sub-quarter-micron interconnect technology because copper has a lower resistivity than aluminum, (1.7 $\mu\Omega$-cm compared to 3.1 $\mu\Omega$-cm for aluminum), a higher current carrying capacity, and significantly higher electromigration resistance. These characteristics are important for supporting the higher current densities experienced at high levels of integration and increased device speed. Further, copper has a good thermal conductivity and is available in a highly pure state.

Despite the desirability of using copper for semiconductor device fabrication, choices of methods for depositing copper into features having high aspect ratios, such as a 10:1 aspect ratio, 0.25 $\mu$m wide vias, are limited. In the past, chemical vapor deposition (CVD) and physical vapor deposition (PVD) were the preferred processes for depositing electrically conductive material into the contacts, vias, lines, or other features formed on the substrate. However, for copper applications, CVD processes are limited to the use of copper containing precursors, which are still being developed, and PVD processes have faced many difficulties for depositing copper conformally in very small features. As a result of the obstacles faced in PVD and CVD copper deposition, electrochemical deposition, which had previously been limited to circuit board fabrication, is being used to fill high aspect ratio features of substrates.

Electrochemical deposition can be achieved by a variety of techniques, such as by electroplating or electroless deposition. In an electroplating deposition, conductive materials are deposited over a substrate surface by chemical reduction in the presence of an external electric current. In particular, electroplating uses a solution, often referred to as an electrochemical bath, of generally positively charged ions of the conductive material, such as copper, to be deposited in contact with a negatively charged substrate of conductive material. The negatively charged substrate provides an electrical path across the surface of the substrate, where an electrical current is supplied to the conductive material to reduce the charged ions and deposit the conductive material. A variety of electrochemical baths may be used, each having different chemical compositions comprising various ingredients or components (hereinafter "constituents") of variable concentrations.

Electrochemical baths may also be used for an electroless deposition of a conductive material. In an electroless deposition, the conductive material is generally provided as charged ions in an electrochemical bath over a catalytically active surface to deposit the conductive metal by chemical reduction in the absence of an external electric current. The electroless process provides selective deposition of the conductive materials at locations where a catalytic material already exists. The electroless process is self-perpetuating to the extent of the availability and composition of the electroless deposition solution and other reactive conditions. Descriptions of the electroless deposition process in Chapter 31 of *Modern Electroplating*, F. Lowenheim, (3d ed.) and in U.S. Pat. No. 5,891,513 are incorporated herein by reference to the extent not inconsistent with the invention.

Providing optimal electrochemical bath compositions is important in sub-micron conductive material deposition applications and volume production of microelectronic devices. One approach to conditioning the electrochemical bath composition during substrate to substrate processing is to analyze the electrochemical bath periodically during the plating process to determine the composition and concentration of the constituents in the electrochemical bath. Then the results of the analysis may be used to adjust the composition of the electrochemical bath by adding constituents that have been consumed during processing of the electrochemical bath.

However, the above described approach has certain deficiencies. Not only is it difficult to reconstitute the initial bath composition, but it has been discovered that the composition of the electrochemical baths will also vary over time. In some instances, an electrochemical bath formed during a deposition process will produce higher quality films than films deposited under the initial processing conditions. For example, the deposition performance of copper is enhanced in the area of grain growth control and management near the "end of life" of the bath than compared to the initial electrochemical bath, often referred to as the "beginning of life" of the electrochemical bath. The "end of life" of the bath is defined as when the one or more constituents of the electrochemical bath have been depleted during the deposition process. Therefore, it is highly desirable to determine the preferred concentration of the constituents of the electrochemical bath under later processing conditions, and to further maintain or produce those processing conditions to produce high quality depositions that are consistent from substrate to substrate. Currently, there is no effective way of maintaining or producing the preferred electrochemical bath compositions that occur under later processing conditions, for example, at or near the "end of life" of the electrochemical bath for copper deposition.

Therefore, there remains a need for a process and apparatus for analyzing and conditioning electrochemical baths.

SUMMARY OF THE INVENTION

The invention generally provides an apparatus and method for adjusting an electrochemical bath during substrate processing. In a specific embodiment of the invention, a process is provided for analyzing an electrochemical bath in an electrochemical deposition system, comprising identifying one or more constituents generated during the electrochemical deposition process (hereinafter, generated constituents).

In a specific embodiment of the invention, a method is provided for analyzing an electrochemical bath in an electrochemical deposition process. The method includes providing a first electrochemical bath having a first bath composition, utilizing the first electrochemical bath in an electrochemical deposition process to form a second electrochemical bath having a second bath composition and analyzing the first and second bath compositions to identify one or more generated constituents. Comparison of the constituents to plating performance is then use to adjust the bath composition.

In another embodiment of the invention, a method is provided for conditioning an electrochemical bath used in an electrochemical deposition process. The method includes providing a first electrochemical bath having a first bath composition, utilizing the first electrochemical bath in an electrochemical deposition process to form a second electrochemical bath having a second bath composition including one or more generated constituents, identifying at least one generated constituent that enhances plating performance, and then modifying the first bath composition to include the at least one generated constituent. A substrate may then be deposited in the modified electrochemical bath and a metal may be electrodeposited onto the substrate.

In another embodiment of the invention, a method is provided for electrochemical deposition of a metal on a substrate. The method includes preparing an electrochemical bath comprising copper and a degradation product of bis (3-sulfopropyl) disulfide, and electrodepositing the metal onto the substrate.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

A detailed description of one or more specific embodiments of the invention will now be described. It is understood, however, that the invention is defined according to the claims and their equivalents, and that the invention itself is broader than the following described embodiments. Accordingly, all references to the "invention" below are intended to be references to the specific embodiments described herein, and do not necessarily refer to the broader invention, nor other embodiments that are within the scope of the broader invention. Accordingly, the invention generally provides a method and apparatus for analyzing and conditioning electrochemical baths to produce an electrochemical bath having a desired chemical composition. In particular, an electrochemical bath is conditioned to have a desired composition, preferably one that replicates the composition of the electrochemical bath at about the end of life of the electrochemical bath, where processing conditions exist that are observed to produce improved control and management of the copper film quality.

An Example Deposition System

The processes described herein may be performed in the following apparatus. Generally, an electrochemical deposition system for conditioning an electrochemical bath includes an electrochemical bath supply tank, in fluid communication with one or more electrochemical process cells, and a source of a constituent generated during the electrochemical deposition process in fluid communication with one or more electro-chemical process cells.

The electrochemical deposition system may further include a chemical analyzer module including one or more chemical analyzers in communication with the electrochemical bath supply tank, which may further include a control system for operating an electrochemical deposition process coupled to the chemical analyzer module and the source of a constituent generated during the electrochemical deposition process. The electrochemical deposition system can be used to condition both electroplating baths and electroless baths.

Figure 1:
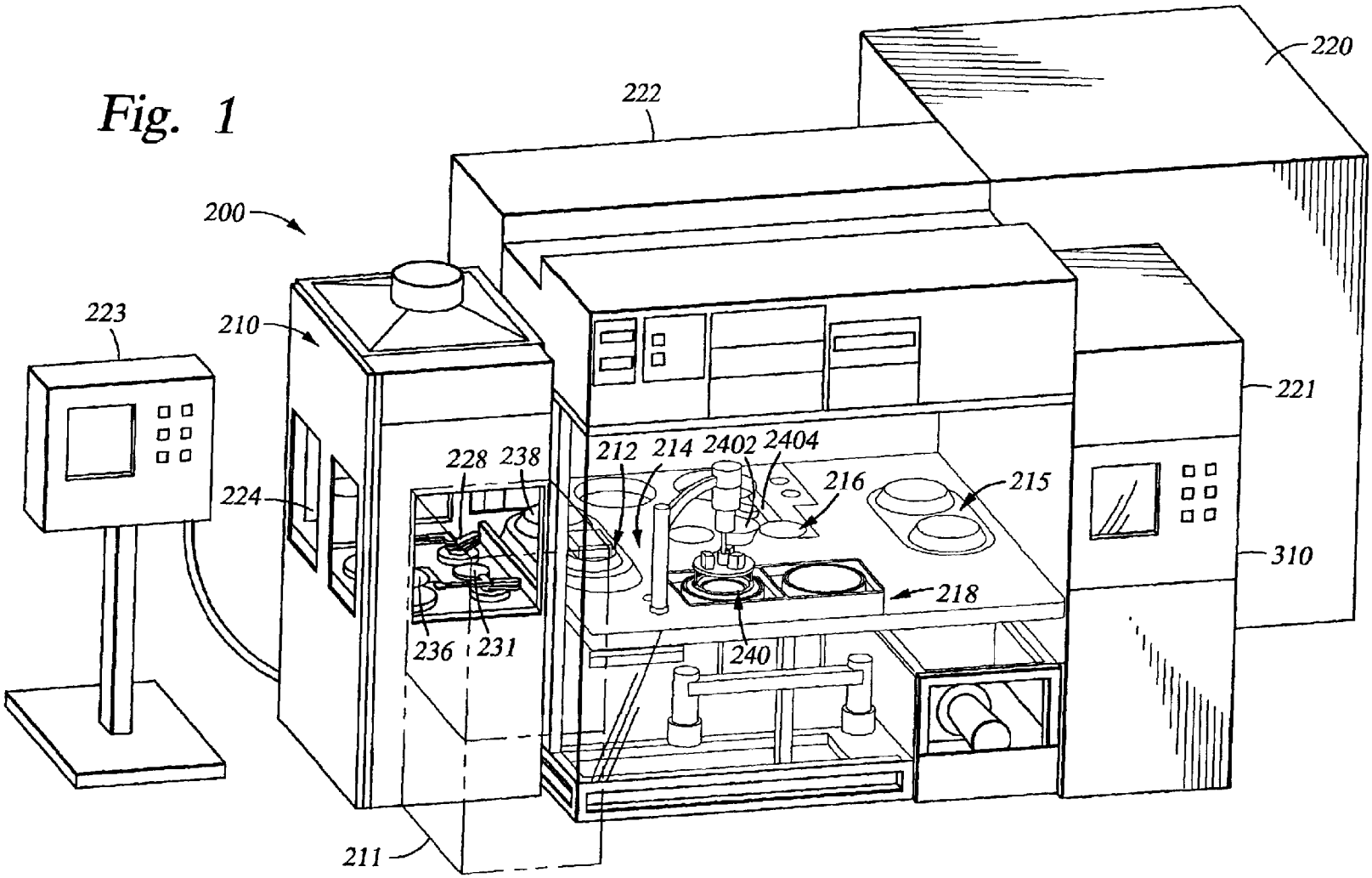
FIG. 1 is a perspective view of an electroplating system platform.
Figure 2:
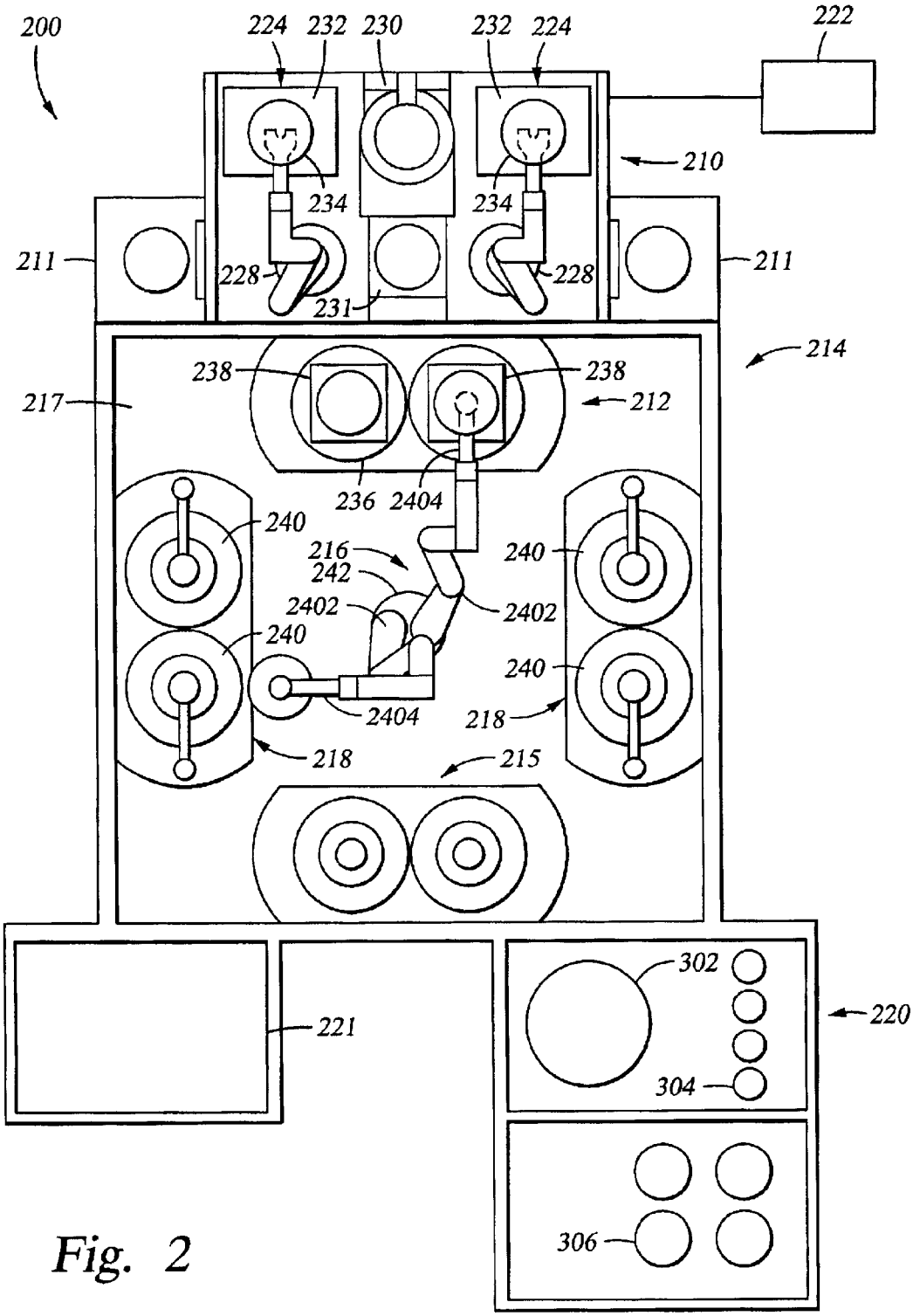
FIG. 2 is a schematic top view of an electroplating system platform.

FIG. 1 is a perspective view of one embodiment of an electroplating system platform 200 in which the electroplating or the electroless deposition process of the invention can be performed. The electroplating system platform 200 is further described in co-pending U.S. patent application Ser. No. 09/289,074, entitled "Electro-Chemical Deposition System", filed on Apr. 8, 1999, which is incorporated herein by reference to the extent not inconsistent with the invention. FIG. 2 is a schematic top view of an electroplating system platform 200 shown in FIG. 1.

Referring to both FIGS. 1 and 2, the electroplating system platform 200 generally includes a loading station 210, a thermal anneal chamber 211, a mainframe 214, and an electrochemical bath conditioning system 220. The mainframe 214 generally includes a mainframe transfer station 216, a spin-rinse dry (SRD) station 212, a plurality of processing stations 218, and a seed layer enhancement station 215. Preferably, the electroplating system platform 200, particularly the mainframe 214, is enclosed in a clean environment using panels such as Plexiglas panels. The mainframe 214 includes a base 217 having cut-outs to support various stations needed to complete the electrochemical deposition process. The base 217 is preferably made of aluminum, stainless steel or other rigid materials that can support the various stations disposed thereon.

A chemical protection coating, such as Halar™, ethylene-chloro-tri-fluoro-ethaylene (ECTFE), or other protective coatings, is preferably disposed over the surfaces of the base 217 that are exposed to potential chemical corrosion. Each processing station 218 includes one or more processing cells 240. An electrochemical bath conditioning system 220 is positioned adjacent the mainframe 214 and connected to the process cells 240 individually to circulate electrolyte and constituent used for the electroplating process. The electroplating system platform 200 also includes a power supply station 221 for providing electrical power to the system and a control system 222, typically including a programmable microprocessor.

The loading station 210 preferably includes one or more substrate cassette receiving areas 224, one or more loading station transfer robots 228 and at least one substrate orientor 230. A number of substrate cassette receiving areas, loading station transfer robots 228 and substrate orientor included in the loading station 210 can be configured according to the desired throughput of the system. As shown for one embodiment in FIGS. 1 and 2, the loading station 210 includes two substrate cassette receiving areas 224, two loading station transfer robots 228 and one substrate orientor 230.

A substrate cassette 232 containing substrates 234 is loaded onto the substrate cassette receiving area 224 to introduce substrates 234 into the electroplating system platform. The loading station transfer robot 228 transfers substrates 234 between the substrate cassette 232 and the substrate orientor 230. The loading station transfer robot 228 includes a typical transfer robot commonly known in the art. The substrate orientor 230 positions each substrate 234 in a desired orientation to ensure that the substrate is properly processed. The loading station transfer robot 228 also transfers substrates 234 between the loading station 210 and the SRD station 212 and between the loading station 210 and the thermal anneal chamber 211. The loading station 210 preferably also includes a substrate cassette 231 for temporary storage of substrates as needed to facilitate efficient transfer of substrates through the system.

FIG. 2 also shows a mainframe transfer robot 242 having a flipper robot 2404 incorporated therein to the extent not inconsistent with the invention. The mainframe transfer robot 242 serves to transfer substrates between different stations attached to the mainframe station, including the processing stations and the SRD stations. The mainframe transfer robot 242 includes a plurality of robot arms 2402 (two shown), and a flipper robot 2404 is attached as an end effector for each of the robot arms 2402. Flipper robots are generally known in the art and can be attached as end effectors for substrate handling robots, such as model RR701, available from Rorze Automation, Inc., located in Milpitas, Calif.

The main transfer robot 242 having a flipper robot as the end effector is capable of transferring substrates between different stations attached to the mainframe as well as flipping the substrate being transferred to the desired surface orientation. For example, the flipper robot flips the substrate processing surface face-down for the electroplating process in the processing cell 240 and flips the substrate processing surface face-up for other processes, such as the spin-rinse-dry process. Preferably, the mainframe transfer robot 242 provides independent robot motion along the X-Y-Z axes by the robot arm 2402 and independent substrate flipping rotation by the flipper robot end effector 2404.

The rapid thermal anneal (RTA) chamber 211 is preferably connected to the loading station 210, and substrates are transferred into and out of the RTA chamber 211 by the loading station transfer robot 228. The electroplating system preferably includes two RTA chambers 211 disposed on opposing sides of the loading station 210, corresponding to the symmetric design of the loading station 210. Thermal anneal process chambers are generally well known in the art, and rapid thermal anneal chambers are typically utilized in substrate processing systems to enhance the properties of the deposited materials. The invention contemplates utilizing a variety of thermal anneal chamber designs, including hot plate designs and heat lamp designs, to enhance the electroplating results. One particular thermal anneal chamber useful for the invention described herein is the RTP XEplus chamber available from Applied materials, Inc., located in Santa Clara, Calif.

Preferably, the SRD station 212 includes one or more SRD modules 236 and one or more substrate pass-through cassettes 238. Preferably, the SRD station 212 includes two SRD modules 236 corresponding to the number of loading station transfer robots 228, and a substrate pass-through cassette 238 is positioned above each SRD module 236. The substrate pass-through cassette 238 facilitates substrate transfer between the loading station 210 and the mainframe 214. The substrate pass-through cassette 238 provides access to and from both the loading station transfer robot 228 and a robot in the mainframe transfer station 216.

The SRD module 238 is disposed adjacent the loading station 210 and serves as a connection between the loading station 210 and the mainframe 214. Referring to FIGS. 1 and 2, the mainframe 214, as shown, includes two processing stations 218 disposed on opposite sides, each processing station 218 having two processing cells 240. The mainframe transfer station 216 includes a mainframe transfer robot 242 disposed centrally to provide substrate transfer between various stations on the mainframe. Preferably, the mainframe transfer robot 242 includes a plurality of individual robot arms 2402 that provides independent access of substrates in the processing stations 218 the SRD stations 212, the seed layer enhancement stations 215, and other processing stations disposed on or in connection with the mainframe.

As shown in FIG. 1, the mainframe transfer robot 242 includes two robot arms 2402, corresponding to the number of processing cells 240 per processing station 218. Each robot arm 2402 includes an end effector for holding a substrate during a substrate transfer. Preferably, each robot arm 2402 is operable independently of the other arm to facilitate independent transfers of substrates in the system. Alternatively, the robot arms 2402 operate in a linked fashion such that one robot extends as the other robot arm retracts.

Figure 3:
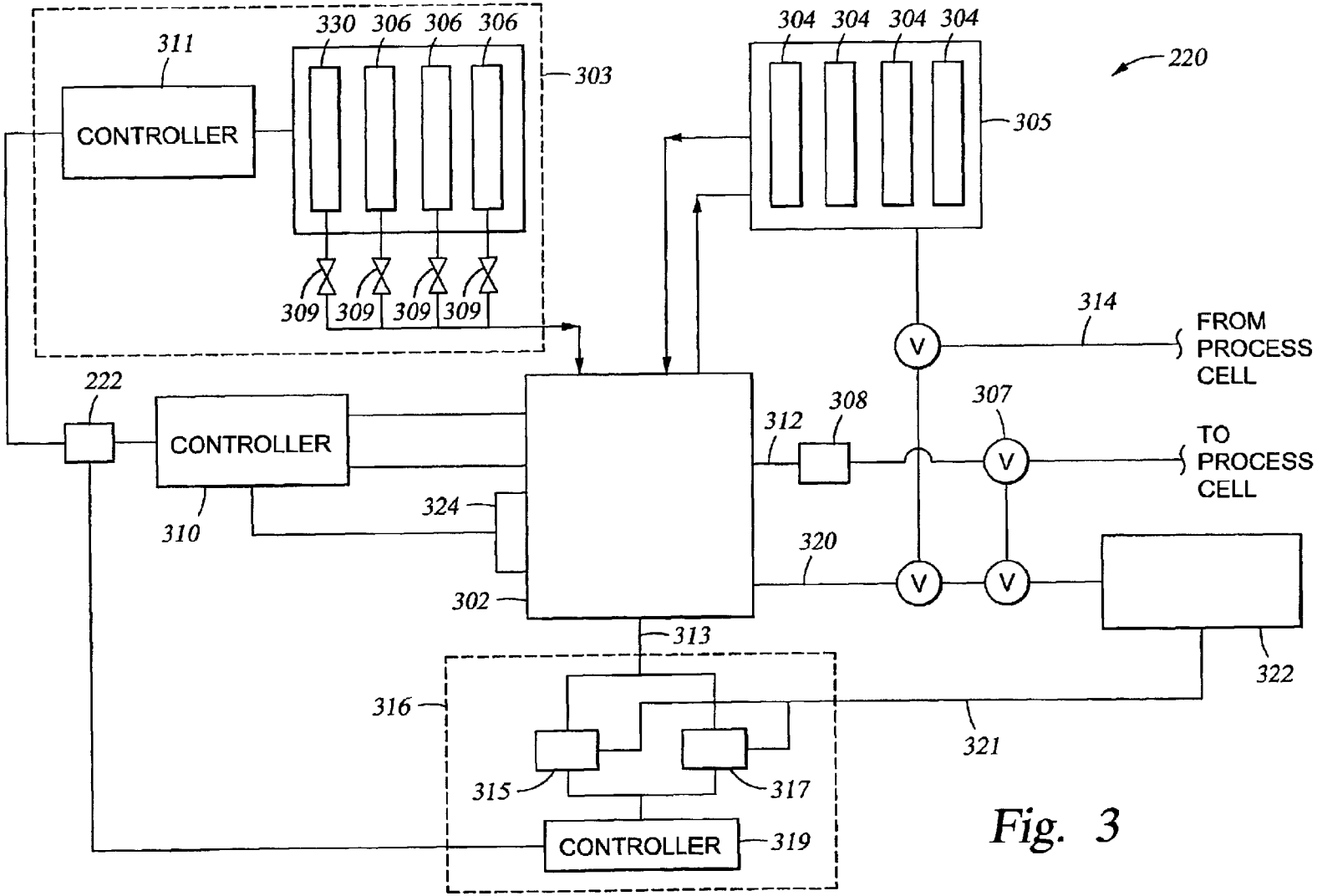
FIG. 3 is a schematic diagram of an electrochemical bath conditioning system.

FIG. 3 is a schematic diagram of an electrochemical bath conditioning system 220. The electrochemical bath conditioning system 220 provides the electrolyte and constituent generated during the electrochemical deposition process, referred to herein as the constituent, to the electroplating process cells for the electroplating process. The electrochemical bath conditioning system 220 generally includes a electrochemical bath supply tank 302, a conditioning module 303, a filtration module 305, a chemical analyzer module 316, and an electrochemical bath waste disposal system 322 connected to the analyzing module 316 by a waste drain 320. One or more controllers 310, 311, and 319 control the composition of the electrolyte and the constituent in the electrochemical bath supply tank 302 and the operation of the electrochemical bath conditioning system 220. Preferably, the controllers are independently operable but integrated with the control system 222 of the electroplating system platform 200.

The electrochemical bath supply tank 302 provides a reservoir for electrolyte and constituent which includes an electrochemical bath supply line 312 that is connected to each of the electroplating process cells through one or more fluid pumps 308 and valves 307. A heat exchanger 324 or a heater/chiller disposed in thermal connection with the electrochemical bath supply tank 302 controls the temperature of the electrolyte and constituent stored in the electrochemical bath supply tank 302. The heat exchanger 324 is connected to and operated by the controller 310.

The conditioning module 303 is connected to the electrochemical bath supply tank 302 by a supply line and includes a plurality of source tanks 306, 330, or feed bottles, a plurality of valves 309, 311, and a controller 311. The source tanks 306, 330 contain the chemicals needed for composing the electrolyte and constituent, and typically include a deionized water source tank and copper sulfate ($CuSO_4$) source tank for composing the electrolyte. One or more of the source tanks 330 (one is shown in FIG. 3) contain the constituent generated during the electrochemical deposition process for addition to the electrochemical bath. The constituent storage tank 330 of the conditioning module 303 is preferably regulated by valve 331 and controlled by controller 311. Other source tanks 306 may contain hydrogen sulfate ($H_2SO_4$), hydrogen chloride (HCl) and various additives such as glycol. The deionized water source tank preferably also provides deionized water to the system for cleaning the system during maintenance.

The valves 309 and 331 associated with each source tank 306, 330 regulate the flow of chemicals to the electrochemical bath supply tank 302 and may be any of numerous commercially available valves such as butterfly valves, throttle valves and the like. Activation of the valves 309 and 331 is accomplished by the controller 311, which is preferably connected to the system control 222 to receive signals therefrom.

The electrochemical bath filtration module 305 includes a plurality of filter tanks 304. An electrochemical bath return line 314 is connected between each of the process cells and one or more filter tanks 304. The filter tanks 304 remove the undesired contents in the used electrochemical bath before returning the electrochemical bath to the electrochemical bath supply tank 302 for re-use.

The electrochemical bath supply tank 302 is also connected to the filter tanks 304 to facilitate re-circulation and filtration of the electrolyte and constituent in the electrochemical bath supply tank 302. By re-circulating the electrochemical bath from the electrochemical bath supply tank 302 through the filter tanks 304, the undesired contents in the electrochemical bath are continuously removed by the filter tanks 304 to maintain a consistent level of purity. Additionally, re-circulating the electrochemical bath between the electrochemical bath supply tank 302 and the filtration module 305 allows the various chemicals in the electrochemical bath to be thoroughly mixed.

The conditioning system 220 also includes a chemical analyzer module 316 that provides real-time chemical analysis of the chemical composition of the electrolyte and constituent. The analyzer module 316 is fluidly coupled to the electrochemical bath supply tank 302 by a sample line 313 and to the waste disposal system 322 by an outlet line 321. The analyzer module 316 generally includes at least one analyzer and a controller to operate the analyzer.

The number of analyzers required for a particular processing tool depends on the composition of the electrochemical bath. For example, while a first analyzer may be used to monitor the concentrations of organic substances, a second analyzer is needed for inorganic chemicals. Additional analyzers may be used to monitor specific constituents to be added to the electrochemical bath, preferably a constituent whose concentration can influence deposition quality, such as the constituent generated during the electrochemical deposition process.

In the specific embodiment shown in FIG. 3 the chemical analyzer module 316 includes an auto titration analyzer 315 and a cyclic voltametric stripper (CVS) 317. Both analyzers are commercially available from various suppliers. An auto titration analyzer that may be used to advantage is available from Parker Systems and a cyclic voltametric stripper is available from ECl.

The auto titration analyzer 315 determines the concentrations of inorganic substances such as copper chloride and acid for a copper deposition. The CVS 317 determines the concentrations of organic substances such as the various additives which may be used in the electrolyte and by-products resulting from the processing, such as the constituent generated during the electrochemical deposition process, which are returned to the electrochemical bath supply tank 302 from the process cells. The analyzer module shown FIG. 3 is merely illustrative. In another embodiment each analyzer may be coupled to the electrochemical bath supply tank by a separate supply line and be operated by separate controllers. Persons skilled in the art will recognize other embodiments.

In operation, a sample of electrolyte and constituent, the electrochemical bath, is flowed to the analyzer module 316 via the sample line 313. Although the sample may be taken periodically, preferably a continuous flow of electrolyte and constituent is maintained to the analyzer module 316. A portion of the sample is delivered to the auto titration analyzer 315 and a portion is delivered to the CVS 317 for the appropriate analysis. The controller 319 initiates command signals to operate the analyzers 315, 317 in order to generate data.

The information from the chemical analyzers 315, 317 is then communicated to the control system 222. The control system 222 processes the information and transmits signals that include user-defined chemical dosage parameters to the conditioning controller 311. The received information is used to provide real-time adjustments to the source chemical conditioning rates by operating one or more of the valves 309 and 331 thereby maintaining a desired, and preferably constant, chemical composition of the electrolyte and constituent throughout the electroplating process. Addition of constituents at the beginning of the electrochemical bath or continuously or periodically during the deposition process can also be initiated by the control system 222 via the controller 311. The waste electrochemical bath from the analyzer module is then flowed to the waste disposal system 322 via the outlet line 321.

Although a preferred embodiment utilizes real-time monitoring and adjustments of the electrochemical bath, various alternatives may be employed according to the invention described herein. For example, the conditioning module 303 may be controlled manually by an operator observing the output values provided by the chemical analyzer module 316. Preferably, the system software allows for both an automatic real-time adjustment mode as well as an operator (manual) mode. Further, although multiple controllers are shown in FIG. 1, a single controller may be used to operate various constituents of the system such as the chemical analyzer module 316, the conditioning module 303, and the heat exchanger 324. Other embodiments will be apparent to those skilled in the art.

The electrochemical bath conditioning system 220 also includes an electrochemical bath waste drain 320 connected to an electrochemical bath waste disposal system 322 for safe disposal of used electrolytes, constituents, chemicals and other fluids used in the electroplating system. Preferably, the electroplating cells include a direct line connection to the electrochemical bath waste drain 320 or the electrochemical bath waste disposal system 322 to drain the electroplating cells without returning the electrochemical bath through the electrochemical bath conditioning system 220. The electrochemical bath conditioning system 220 preferably also includes a bleed off connection to bleed off excess electrolyte and constituent to the electrochemical bath waste drain 320.

Although not shown in FIG. 3, the electrochemical bath conditioning system 220 may include a number of other constituents. For example, the electrochemical bath conditioning system 220 preferably also includes one or more additional tanks for storage of chemicals for a wafer cleaning system, such as the SRD station. Double-contained piping for hazardous material connections may also be employed to provide safe transport of the chemicals throughout the system. Optionally, the electrochemical bath conditioning system 220 includes connections to additional or external electrochemical bath processing system to provide additional electrochemical bath supplies to the electroplating system.

Referring back to FIGS. 1 and 2, the electroplating system platform 200 includes a control system 222 that controls the functions of each constituent of the platform. Preferably, the control system 222 is mounted above the mainframe 214 and includes a programmable microprocessor. The programmable microprocessor is typically programmed using software designed specifically for controlling all constituents of the electroplating system platform 200. The control system 222 also provides electrical power to the constituents of the system and includes a control panel 223 that allows an operator to monitor and operate the electroplating system platform 200. The control panel 223 is a stand-alone module that is connected to the control system 222 through a cable and provides easy access to an operator. Generally, the control system 222 coordinates the operations of the loading station 210, the RTA chamber 211, the SRD station 212, the mainframe 214 and the processing stations 218. Additionally, the control system 222 coordinates with the controller of the electrochemical bath conditioning system 220 to provide the electrochemical bath for the electroplating process.

Preferably, the electroless deposition applicator is a separate cell or module that performs the electroless deposition process, herein referred to as an electroless deposition processing (EDP) cell. The EDP cell can be located at the rearward portions, distal from the entry of the substrates, of the electroplating system platform 200. In the embodiment shown, two EDP cells can be arranged side-by-side for greater throughput rates.

Analyzing and Conditioning Processes

Figure 4:
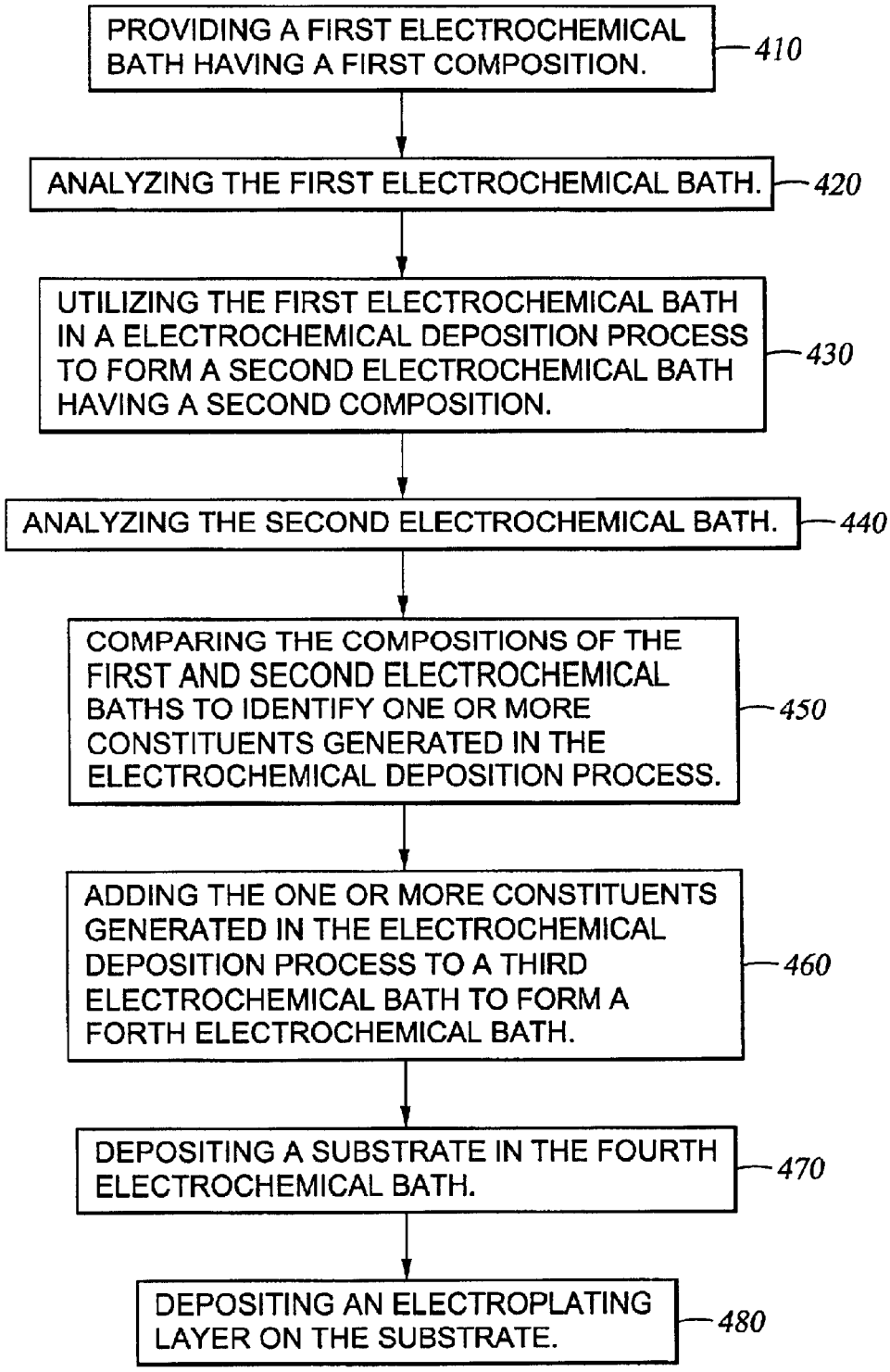
FIG. 4 is a flow chart illustrating steps undertaken in analyzing and conditioning an electrochemical bath according to one embodiment described herein.

FIG. 4 is a flow chart illustrating steps undertaken in analyzing and conditioning an electrochemical bath according to one embodiment of the invention. The term "analyzing" is defined herein as any method of examination to determine the constituents or component parts of an object, composition, or process. The term "constituents" is defined herein as ingredients or components of an electrochemical bath, "identifying" is defined herein as any determination of the chemical name, formula, or composition of a constituent or of a solution containing one or more constituents, and "comparing" is defined herein as any examination of two or more compositions or constituents in order to establish the similarities and/or differences between the objects, compositions, or processes.

An electrochemical bath having a first electrochemical bath composition is provided 400 to an electrochemical deposition processing system capable of processing the electrochemical bath. The first electrochemical bath is first analyzed 410 to determine the composition of initial chemical constituents, such as copper electrolytes and electrolyte additives, of the electrochemical bath, and the respective initial concentrations of the constituents.

The first electrochemical bath is then utilized 420 in an electrochemical deposition process where initial constituents of the first electrochemical bath are consumed and new chemical constituents are generated during the deposition process. The consumed and generated constituents produce a second electrochemical bath having a second electrochemical bath composition. The second electrochemical bath is then analyzed 430 to determine the generated constituents and the respective concentrations of the generated constituents after the first electrochemical bath has been utilized.

The analyses are then compared 440 to identify one or more generated constituents and the respective concentrations of the one or more generated constituents in the second electrochemical bath. The analysis may be performed on electrochemical baths such as used in electroplating and electroless deposition methods.

Generally, the compositions of the first and second electrochemical baths are analyzed by directing a portion of the first and second electrochemical baths to a chemical analyzer module. In one embodiment, a sample line provides continuous flow of electrolyte from a main electrolyte tank to the chemical analyzer module. In one embodiment, the chemical analyzer module includes one or more analyzers operated by a controller and integrated with a control system of the electrochemical deposition processing system. For example, the chemical analyzer module can include one analyzer to determine the composition and concentrations of organic substances contained in the electrochemical bath, and another analyzer can be provided to determine the composition and concentrations of inorganic substances.

In a preferred embodiment, at least a portion of the first and second electrochemical baths are analyzed by a high-performance liquid chromatography process. The analysis is preferably performed by generating the composition data of each electrochemical bath, such as by a high-performance liquid chromatography process. Then the composition data is compared to determine the change in composition of the electrochemical baths. The changes in the bath compositions identify at least some of the one or more constituents generated during the deposition process as well as identify which initial constituents were consumed during the process.

It is contemplated that the one or more generated constituents include new constituents produced during the deposition process. It is further contemplated that the one or more generated constituents produced during the deposition process can include constituents that are the same or substantially the same as those constituents provided to form the first, or initial, electrochemical bath.

After the constituents, and the corresponding concentration of the constituents, are identified, an additive material having a composition that is substantially the same as at least some of the one or more generated constituents can be produce externally from the electrochemical deposition process. The additive material to be provided to the electrochemical baths as an additional component is generally produced external of the electrodeposition processes described herein. Externally producing the additive material allows for great flexibility in forming compositions to condition and produce desired electrochemical baths. The additive material may be added to condition an electrochemical bath before or at the beginning of processing to provide a desired material deposition. Additionally, the additive material can be added to condition the electrochemical bath during processing, preferably continuously or periodically, to produce an electrochemical bath with a desired deposition composition.

Referring back to FIG. 4, a third electrochemical bath may be conditioned after the analyses of the first and second electrochemical baths are performed. The third bath is conditioned by providing 450 an additive material having a composition that is substantially the same as at least some of the one or more generated constituents from the second electrochemical bath. The addition of the additive materials produces a fourth electrochemical bath having the composition of the desired electrochemical bath, such as the second chemical electrochemical bath described herein.

Preferably, the first and the third electrochemical baths have the same composition so that the addition of at least some of the one or more generated constituents to the third electrochemical bath will produce a fourth electrochemical bath having the composition of the second electrochemical bath. It is also contemplated that the composition and concentration of the initial constituents of the third electrochemical bath may be modified to reflect the composition and concentration of the initial constituents of the electrochemical bath during processing, such as when the second electrochemical bath was produced.

The additive material having a composition that is substantially the same as at least some the one or more constituents generated during the electrochemical deposition process may be added at the beginning of the use of the electrochemical bath to initially condition the electrochemical bath. The additive material may also be added, either continuously or periodically, to condition the electrochemical bath during the electrochemical deposition.

The fourth electrochemical bath as described above, or another electrochemical bath conditioned by the process described above, may then be used in an electrochemical deposition of a metal on a substrate. In one embodiment, an electrochemical bath including an electrolyte solution and one or more constituents identified as being generated during an electrochemical deposition are provided, a substrate is disposed in the electrochemical bath 460, and a metal 470 layer is deposited onto the substrate.

While the electrochemical depositions described herein are discussed in the context of a copper deposition in an electroless deposition process, the invention contemplates deposition of a variety of materials, such as doped copper, aluminum, and doped aluminum, by a variety of electrochemical deposition processes including electroplating.

One embodiment of the invention for analyzing an electrochemical bath in order to produce and maintain a desired electrochemical bath composition is described as follows. A first electrochemical bath is first provided with known chemical constituents, such as copper electrolytes and electrolyte additives for a copper film deposition, and at known concentrations of the known constituents. The first electrochemical bath includes a conductive material source, and supporting electrolytes, which can include a supply of hydroxide ions to adjust the pH, an acid as a reducing agent, and a surfactant as a wetting agent. In one embodiment, the electrochemical bath includes a conductive metal source of metal ions of copper provided in an aqueous copper electrochemical bath with essentially no added sulfuric acid.

In depositing a copper film in an electrochemical deposition process, the conductive metal source includes copper sulfate, preferably from about 200 to about 350 grams per liter (g/l) of copper sulfate pentahydrate in water ($H_2O$). The copper concentration may be from about 0.2 to about 1.2 Molar (M), and is preferably 0.8 M to about 1.2 M. In addition to copper sulfate, other copper salts, such as copper fluoborate, copper gluconate, copper sulfamate, copper sulfonate, copper pyrophosphate, copper chloride, copper cyanide and the like, all without (or with little) electrolyte may be used to provide the conductive material to the electroless bath.

In some specific applications, it may be beneficial to introduce small amounts of acid, base, or salts into the copper electrochemical bath. Examples of such benefits may be some specific adsorption of ions that may improve specific deposits, complexation, pH adjustment, solubility enhancement or reduction and the like. The invention also contemplates the addition of such acids, bases or salts into the electrolyte in amounts of less than about 0.4 M.

The electrochemical bath composition also contemplates the use of conventional copper plating electrolyte which includes a relatively high sulfuric acid concentration (from about 45 g of $H_2SO_4$ per L of $H_2O$ (0.45M) to about 110 g/L (1.12M)) which is provided to the electrochemical bath to provide high conductivity to the electrolyte. Also contemplated are the addition of acids other than sulfuric acid into the electrolyte to provide for better complexation and/or solubility for the copper ions and the copper metal which results in improved deposition properties. Suitable acids include anthranilic acid, acetic acid, citric acid, lactic acid, sulfamic acid, ascorbic acid, glycolic acid, oxalic acid, benzenedisulfonic acid, tartaric acid, malic acid, and combinations thereof.

The electrochemical baths described herein are typically used at current densities ranging from about 10 mA/cm$^2$ to about 60 mA/cm$^2$. Current densities as high as 100 mA/cm$^2$ and as low as 5 mA/cm$^2$ can also be employed under appropriate conditions. In plating conditions where a pulsed current or periodic reverse current is used, current densities in the range of about 5 mA/cm$^2$ to about 400 mA/cm$^2$ can be used periodically. The operating temperatures of the electrochemical baths may range from about 0° C. to about 95° C. Preferably, the electrochemical baths range in temperature from about 20° C. to about 50° C.

The electrochemical baths of the invention also preferably contain halide ions, such as chloride ions, bromide, fluoride, iodide, chlorate or perchlorate ions typically in amounts less than about 0.5 g/l. However, this invention also contemplates the use of copper electrochemical bath without chloride or other halide ions.

In addition to the constituents described above, the electrochemical bath may contain various additives that are introduced typically in small (parts per million, ppm, range) amounts. The additives typically improve the thickness distribution (levelers), the reflectivity of the plated film (brighteners), its grain size (grain refiners), stress (stress reducers), adhesion and wetting of the part by the electrochemical bath (wetting agents) and other process and film properties. The invention also contemplates the use of additives to produce asymmetrical anodic transfer coefficient ($\alpha_a$) and cathodic transfer coefficient ($\alpha_c$) to enhance filling of the high aspect ratio features during a periodic reverse plating cycle.

The additives practiced in most of the contemplated electrochemical bath compositions constitute small amounts (ppm level) from one or more of the following groups of chemicals:

1) Ethers and polyethers including polyalkylene glycols
2) Organic sulfur constituents and their corresponding salts and polyelectrolyte derivatives thereof.
3) Organic nitrogen constituents and their corresponding salts and polyelectrolyte derivatives thereof.
4) Polar heterocycles
5) A halide ion, e.g., Cl The exemplary electrochemical deposition chemistry and deposition process in the above described embodiment is more fully disclosed in co-pending U.S. patent application Ser. No. 09/114,865, filed on Jul. 13, 1998 and is incorporated herein by reference to the extent not inconsistent with the invention.

The initial, or first, electrochemical bath of known constituents and known concentrations of the constituents is generated and the initial electrochemical bath is used in an electrochemical deposition process. Once the electrochemical bath produces substrates with the desired material deposition, a sample of the initial electrochemical bath may be removed and tested to determine the constituents and corresponding concentrations of the constituents in the new, or second, electrochemical bath.

The testing method can be of any known method in the art that provides for analysis of constituent and constituent concentration. Preferably the testing method is either a high performance liquid chromatography (HPLC) method or a gas chromatograph (GC) mass spectrometry, and is most preferably HPLC. Preferably, the analysis is performed on at least a portion of the bath in situ with the apparatus as described herein. The analysis can be performed before, during, or after the termination of the deposition process. While the above sample was indicated as being taken for an unprocessed electrochemical bath, it is contemplated by the invention that the initial, or first, sample can be taken at any time during the deposition process to determine a suitable composition for a first bath.

Figure 5:
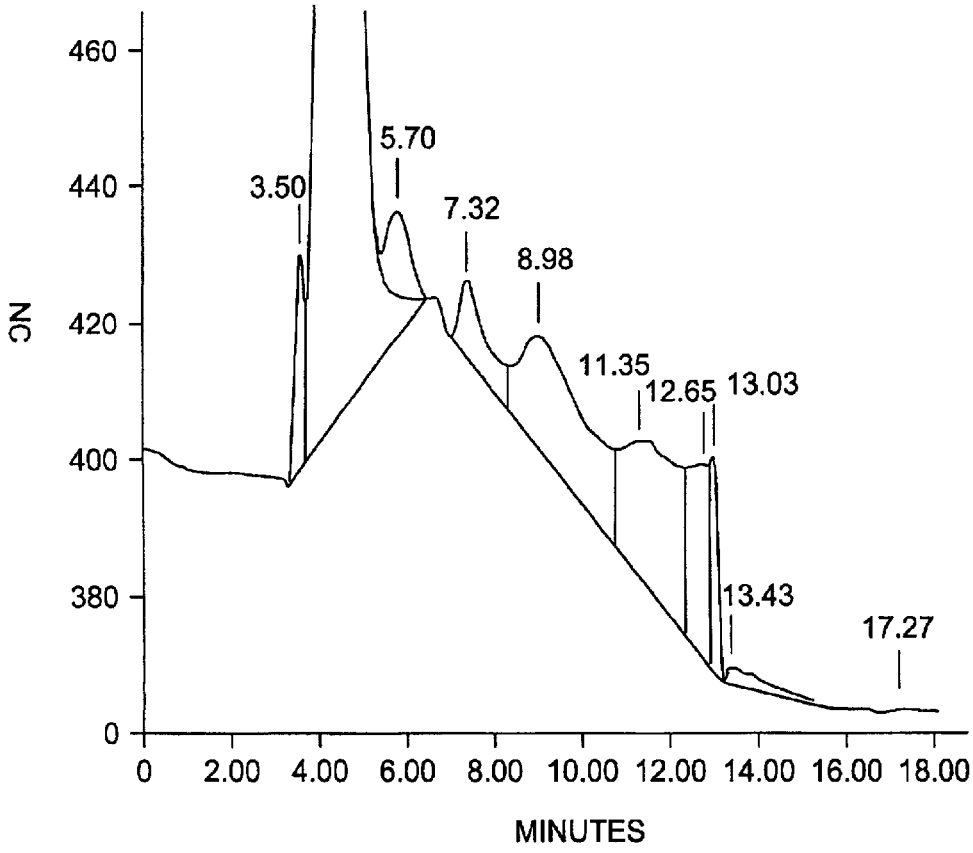
FIG. 5 is a HPLC graph showing the composition and concentration peaks of a electroless bath taken at the beginning of the life of the bath.

Referring to FIG. 5, in one embodiment a bath at the beginning of life with known constituents and concentrations is analyzed by HPLC and the results produced in a HPLC diagram, or HP-chromatogram. One method of HPLC testing includes dissolving a sample of constituents in solvent that is then passed through a tightly packed column of very small, uniformly sized spherical particles of a stationary phase that can absorb the constituents. Constituents with polar molecules are more strongly absorbed and migrate through the stationary phase more slowly than non-polar molecules, which therefore elutes constituents at different times, and thus, separates the constituents. Once the constituents are eluted, the constituents are measured and the concentration of the peak is recorded on the HP-chromatogram.

The presence of a signal on the HP-chromatogram indicates a characteristic molecular structure, with the height of the peaks corresponding to the concentration of the molecular structure appearing in the bath which is shown on the y-axis of the figure. The x-axis measures the time in which the constituent was eluted from the column, which is compared to existing data to determine the likely constituent of the concentration peak. The initial composition of the constituents and the concentration of the constituents of the bath is generally known, thereby allowing the peak signals of the HPLC chromatogram to be accurately determined, and an electrochemical bath profile to be produced.

Figure 6:
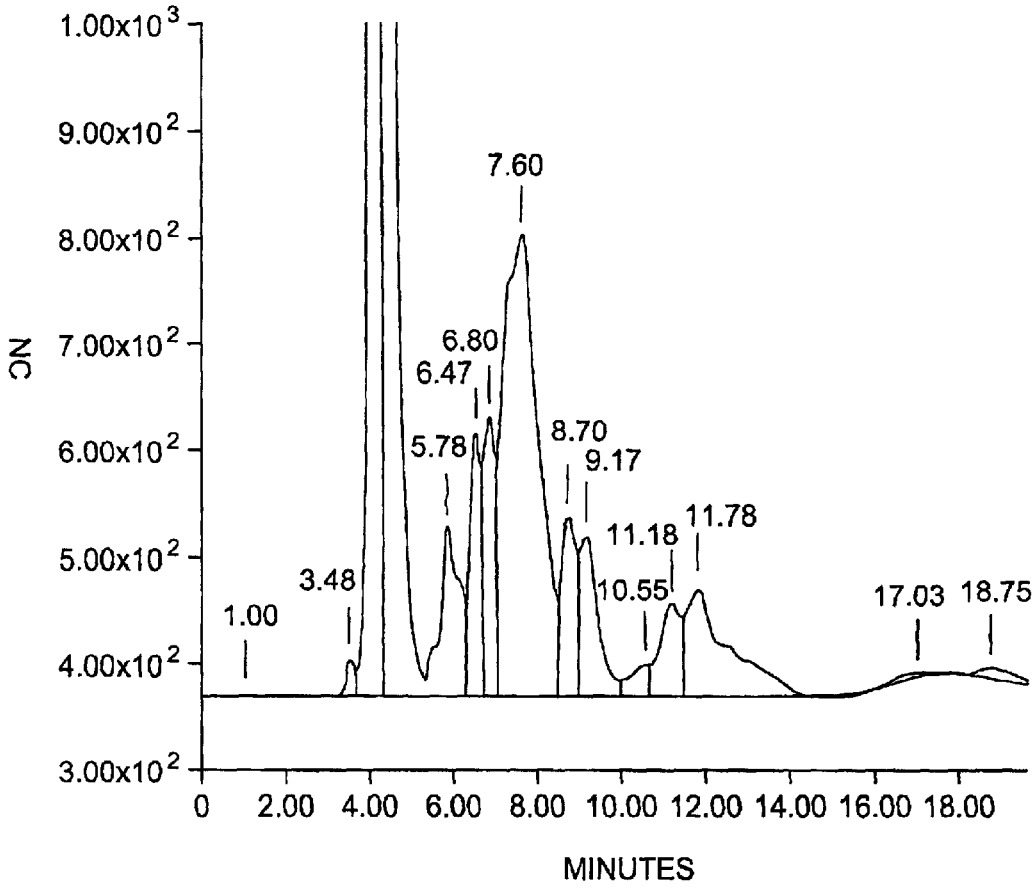
FIG. 6 is a HPLC graph showing the composition and concentration peaks of a electroless bath taken near the "end of life" of the electrochemical bath.

The electrochemical bath is then used in a electrodeposition process. The electrodeposition process includes providing an electrochemical bath to a plating cell or processing tank, depositing a substrate in the electrochemical bath, and then electrodepositing the metal onto the substrate. In one embodiment of the invention, the deposition process is performed until the film deposited on the substrates by the bath exhibits the desired film characteristics. For example, in copper applications, substrate with the desired film characteristics are produced near the "end of life" of the bath. A sample of this second electrochemical bath is then taken and a second HPLC analysis of the bath is conducted for the sample with the results of the constituents and corresponding concentration of the constituents produced on a HPLC chromatogram as shown in FIG. 6.

While preferably, the "end of life" of the bath is chosen for testing in copper deposition, the invention contemplates samples being taken at different times during the deposition process, or periodically during deposition, allowing for more than one comparison of the baths. Additionally, the samples can be used to produce profiles of bath chemistries over the life of the bath for use, amongst other contemplated uses, in determining the replenishing or generating requirements of the baths or other preferred deposition chemistries.

Figure 7:
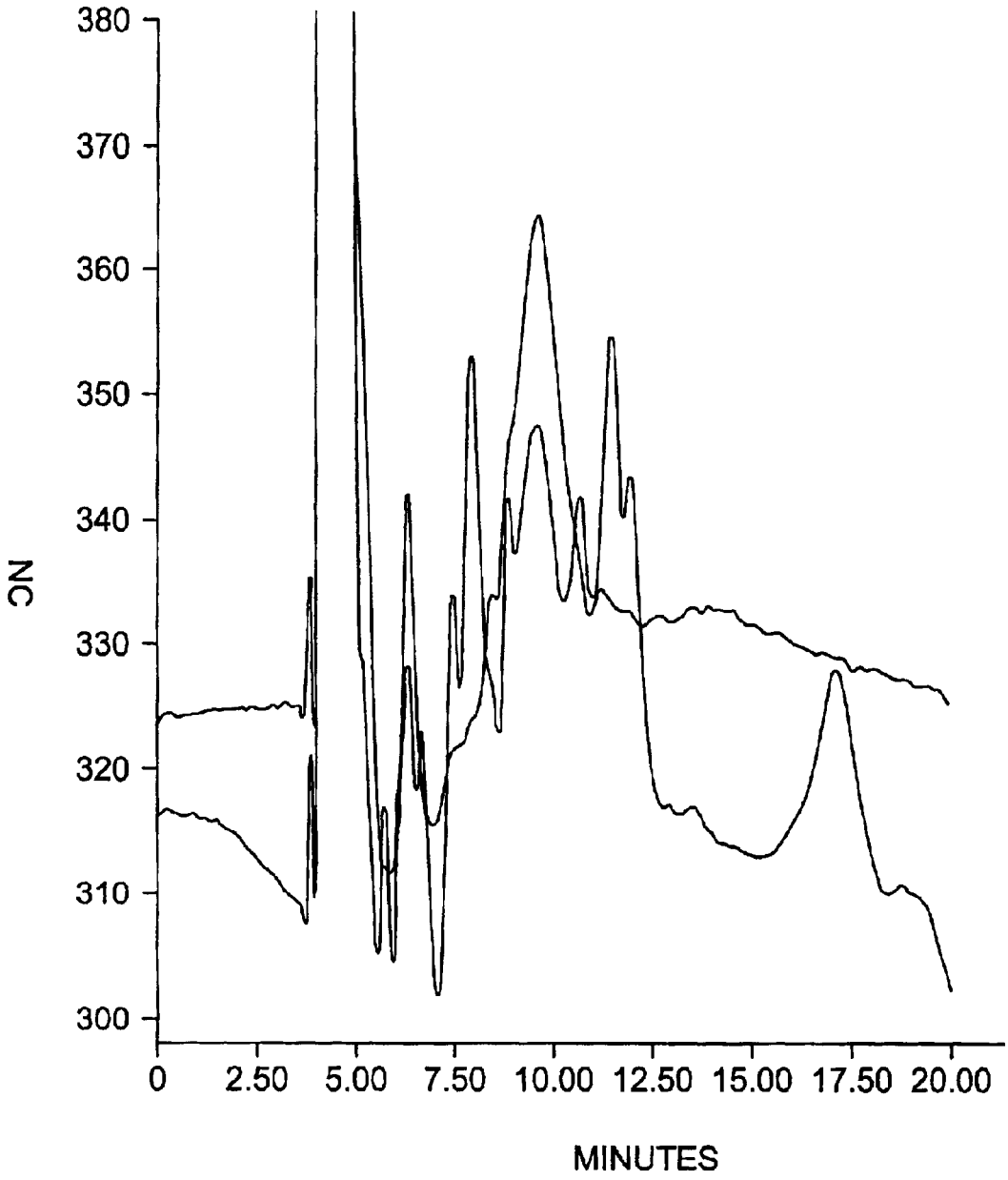
FIG. 7 is a HPLC graph comparing the composition of two electrochemical baths at different stages in an electrodeposition process.

FIG. 7 shows an overlay of two HPLC graphs containing sampling data for an electrochemical bath at the beginning of life compositions during an electrochemical deposition process. With the composition of the bath at the beginning of life known, indicated by the solid line, the corresponding peaks of the corresponding HPLC graph can be identified. Then the composition of the electrochemical bath at the end of life of the electrochemical bath, indicated by the dashed line, can be identified by comparing the changes in the peaks between the second HPLC graph and the initial HPLC graph. The difference in the peaks indicates the change in the constituents and concentrations of the constituents produced during the life of the bath. This comparison of peaks allows for identifying any constituent generated or consumed during the electrochemical deposition process and the corresponding concentration of the respective constituent. Identifying the generated constituents allows for the determination of the composition of the desired electrochemical bath.

For example, constituents commonly used in electrochemical baths such as brighteners improve the reflectivity of the deposition surface by enhancing uniformity of the crystalline structure. Brighteners may also act as accelerators to influence the deposition of conductive material on the substrate by increasing the deposition rate of the conductive materials. Examples of chemicals which act as accelerators in electrochemical baths include organic sulfur compounds, salts of organic sulfur compounds, polyelectrolyte derivatives thereof, and mixtures thereof, for example, bis (3-sulfopropyl) disulfide, $C_6H_{12}Na_2O_6S_4$, commercially available from the Raschig Corp. of Germany. It is believed that the disulfide decomposes into two or more sulfide components during the deposition process, where at least one of the two or more sulfide components enhance acceleration of the deposition rate with a desired crystalline structure. Therefore it is desirable to form an electrochemical bath having an initial concentration of the one or more sulfide components at the concentration level as identified in the desired electrochemical bath for deposition of conductive material.

Analyzing a sample of the electrochemical bath at the beginning of the life of the electrochemical bath will indicate the composition of the disulfide and sulfide constituents, and analyzing a sample of a electrochemical bath which exhibits a desired deposition will indicate the respective changes in the compositions of the disulfide and sulfide components. The analyses can identify which sulfide components, and respective concentration, are generated during the deposition process to form the electrochemical bath with the desired deposition. The generated sulfide components can then be added to the electrochemical bath with an existing, or modified, disulfide composition to produce the desired electrochemical bath composition. It is contemplated that the above described analysis may be performed on all constituents of all known electrochemical baths, such as electroplating baths and electroless baths.

Once identified, an additive material having a composition that is substantially the same as at least some of the one or more constituents generated during the electrochemical deposition process can be added to the electrochemical bath to condition the electrochemical bath to have desired compositions. For example, the composition of the bath near the "end of life" of the bath can be produced by adding an additive material having the desired composition. The additive material may be added to the electrochemical bath before or at the beginning of processing, or can be added to the bath during processing, preferably continuously or periodically, to produce an electrochemical bath with a desired deposition composition.

It is contemplated that analyzing and conditioning processes described herein may provide a consistent, desired electrochemical bath composition over the life of the electrochemical bath and from substrate to substrate for consistent high quality deposition of the conductive materials. For example, it has been discovered that the composition of a electrochemical bath at near the "end of life" of the electrochemical bath can deposit copper films having improved grain growth control and management, thereby producing higher quality films. As such, the desired composition of a electrochemical bath is the composition of the electrochemical bath near the "end of life" of the electrochemical bath.

Further, it is contemplated that the electrochemical bath can be produced and maintained at the desired composition by adding some of the one or more generated constituents to an electrochemical bath. The addition of some of the one or more generated constituents to the electrochemical bath can produce consistent substrate to substrate deposition by the desired electrochemical bath plating composition over the life of the electrochemical bath. Further, by controlling the composition of the electrochemical bath, particularly the constituents produced in the electrochemical bath, the life of the electrochemical bath can be enhanced. Extending the life of the bath can prevent pre-mature discharge of the electrochemical bath, which may lower the cost of production, the cost of waste treatment, and provide higher substrate throughput.

While foregoing is directed to the preferred embodiment of the present invention, other and further embodiments of the invention may be devised without departing from the basic scope thereof, and the scope thereof is determined by the claims that follow.

What is claimed is:

1. A method of adjusting an electrochemical bath for an electrochemical deposition process, comprising:

a) providing a first copper electroless bath having a first bath composition;

b) utilizing a portion of the first copper electroless bath in an electroless deposition process to form a second copper electroless bath having a second copper electroless bath composition comprising one or more generated constituents;

c) identifying at least some of the one or more generated constituents by determining the first and second copper electroless bath compositions, wherein identifying at least some of the one or more constituents generated during the electrochemical deposition process comprises:

(i) analyzing a portion of the first copper electroless bath to determine the first bath composition;

(ii) analyzing a portion of the second copper electroless bath to determine the second bath composition; and (iii) comparing the first and second copper electroless bath compositions to identify at least some of the one or more constituents generated in the electroless deposition process; and d) adding an additive material having a composition that is substantially the same as at least some of the one or more generated constituents to a third copper electroless bath to form a fourth copper electroless bath.

2. The method of claim 1, wherein the third copper electroless bath has the composition of the first copper electroless bath.

3. The method of claim 1, wherein analyzing a portion of the first copper electroless bath comprises directing the portion of the first copper electroless bath is directed to a chemical analyzer and separating and identifying constituents of the first copper electroless bath by a high-performance liquid chromatography process.

4. The method of claim 1, wherein analyzing a portion of the second copper electroless bath comprises directing at least a portion of the first copper electroless bath is directed to a chemical analyzer and separating and identifying constituents of the second copper electroless bath by a high-performance liquid chromatography process.

5. A method of adjusting an electrochemical bath for an electrochemical deposition process, comprising:

a) providing a first copper electrochemical bath having a first bath composition;

b) utilizing a portion of the first copper electrochemical bath in an electrochemical deposition process to form a second copper electrochemical bath having a second copper electrochemical bath composition comprising one or more generated constituents;

c) identifying at least some of the one or more generated constituents by determining the first and second copper electrochemical bath compositions, wherein identifying at least some of the one or more constituents generated during the electrochemical deposition process comprises:

(i) analyzing a portion of the first copper electrochemical bath to determine the first bath composition;

(ii) analyzing a portion of the second copper electrochemical bath to determine the second bath composition; and (iii) comparing the first and second copper electrochemical bath compositions to identify at least some of the one or more constituents generated in the electrochemical deposition process; and d) adding an additive material having a composition that is substantially the same as at least some of the one or more generated constituents to a third copper electrochemical bath to form a fourth copper electrochemical bath.

6. The method of claim 5, wherein the third copper electrochemical bath has the composition of the first copper electrochemical bath.

7. The method of claim 5, wherein analyzing a portion of the first copper electrochemical bath comprises directing the portion of the first copper electrochemical bath to a chemical analyzer and separating and identifying constituents of the first copper electrochemical bath by a high-performance liquid chromatography process.

8. The method of claim 5, wherein analyzing a portion of the second copper electrochemical bath comprises directing at least a portion of the second copper electrochemical bath to a chemical analyzer and separating and identifying constituents of the second copper electrochemical bath by a high-performance liquid chromatography process.

* * * * *

UNITED STATES PATENT AND TRADEMARK OFFICE

CERTIFICATE OF CORRECTION

PATENT NO. : 6,893,548 B2 
DATED : May 17, 2005
INVENTOR(S) : Robin Cheung et al.

It is certified that error appears in the above-identified patent and that said Letters Patent is hereby corrected as shown below:

Column 13,
Line 7, should read -- 5) A halide ion, e.g., $Cl^-$ --.

Signed and Sealed this

Twenty-third Day of August, 2005

JON W. DUDAS
*Director of the United States Patent and Trademark Office*